United States Patent [19]

Santore

[11] 4,063,317

[45] Dec. 20, 1977

[54] HYDRO-PNEUMATIC PIPE, TUBE AND DRAIN CLEANER

[76] Inventor: Michael Santore, 150 Bergen Turnpike, Ridgefield Park, N.J. 07660

[21] Appl. No.: 631,738

[22] Filed: Nov. 13, 1975

[51] Int. Cl.[2] ..... E03D 11/00; B08B 9/02

[52] U.S. Cl. ..... 4/255; 15/406; 134/166 C

[58] Field of Search ..... 4/255, 256, 257, 192; 134/17, 22 C, 166 C; 15/406

[56] References Cited

U.S. PATENT DOCUMENTS

| | | | |
|---|---|---|---|
| 1,998,902 | 4/1935 | Mattich | 4/255 X |
| 2,266,288 | 12/1941 | Thompson | 4/255 X |
| 2,300,319 | 10/1942 | Smith | 4/255 |
| 2,820,467 | 1/1958 | Mattich | 4/255 |
| 3,009,837 | 11/1961 | Lipp et al. | 134/17 |
| 3,062,152 | 11/1962 | Huff | 4/255 X |
| 3,156,584 | 11/1964 | Yurdin | 134/17 |
| 3,426,774 | 2/1969 | Conn | 134/166 C |
| 3,790,966 | 2/1974 | Keane | 4/192 |
| 3,879,771 | 4/1975 | Nakane | 4/255 |

*Primary Examiner*—Richard E. Aegerter
*Assistant Examiner*—Stuart S. Levy
*Attorney, Agent, or Firm*—Donald R. Heiner

[57] ABSTRACT

A device for unclogging blocked pipes, tubes, drains and other conduits employing a source of compressed gas such as a $CO_2$ cartridge or air compressor and a secondary source of compressed gas and/or liquid. A compressed gas storage chamber receives and holds the compressed gas until a desired predetermined pressure is reached at which time a valve is opened allowing the gas under pressure to flow to the conduit to be unclogged. Simultaneously, and if required, a secondary source of compressed gas and/or liquid can be led into the conduit to be unclogged, downstream of the storage chamber release valve. An automatic safety gas relief valve is also disposed downstream of the storage chamber release valve for safety.

2 Claims, 2 Drawing Figures

HYDRO-PNEUMATIC PIPE, TUBE AND DRAIN CLEANER

BACKGROUND OF THE INVENTION

The present invention relates generally to the field of unclogging blocked pipes, tubes, drains and other conduits which are blocked due to foreign objects such as rags, rocks, cans, scale, rust, etc. More particularly the instant invention does not employ mechanical means such as rotatable snakes, screws or plungers but uses a source of compressed gas, such as carbon dioxide or air in conjunction with a secondary source of compressed gas and/or liquid if required. The mechanical devices mentioned above often compound the problem by breaking off in the conduit to be unclogged, and, even when successful, present a clean up problem. The instant invention is safe, portable, clean and efficient as compared to these mechanical devices and offers several advantages over the other compressed gas devices as will become clear upon reading the description.

PRIOR ART

The most pertinent prior art patents uncovered during the search appear to be the patents to Yurdin U.S. Pat. No. 3,156,584; Wikelund U.S. Pat. No. 2,267,064; and Lipp et al U.S. Pat. No. 3,009,837.

The patent to Yurdin U.S. Pat. No. 3,156,584 differs from the instant invention in that it employs a liquefied gas carrier and an atomized solvent to open up obstructed lines. Further, there is no provision for a secondary source of compressed gas and/or liquid nor a compressed gas storage chamber and pressure relief valve as in the instant invention.

The patent to Wikelund U.S. Pat. No. 2,267,064 relies on a piston and cylinder hand operated pump, and a supply of hydraulic fluid disposed in a space between cylinders. Several reciprocations of the pump handle are required to clear out the stoppage. The instant invention does not rely on a piston-cylinder, hand operated pump nor on a source of hydraulic fluid but rather used a source of compressed gas and a secondary source of compressed gas and/or liquid.

The patent to Lipp et al U.S. Pat. No. 3,009,837 necessarily depends upon supplying a liquid column between the stoppage and a blank cartridge. The blank cartridge in turn is fired into the column of liquid sending shock waves through the liquid. Thus Lipp et al does not provide a source of compressed gas, a secondary source of compressed gas nor a compressed gas storage chamber. Further, the instant invention does not necessarily depend upon supplying a liquid column between the stoppage and the compressed gas source.

SUMMARY OF THE INVENTION

Thus, the present invention relates to an effective, safe, clean, efficient means for unclogging blocked pipes, tubes, drains and other conduits including a source of compressed gas, a storage chamber for receiving and storing the compressed gas, a pressure gauge disposed in the storage chamber, an inlet control valve disposed between the compressed gas source and the storage chamber, a check valve disposed between the storage chamber and the inlet control valve, a discharge control valve downstream of the storage chamber operatively associated with a discharge manifold which is connected to the storage chamber, a secondary compressed gas and liquid inlet valve connected to the discharge manifold, an automatic safety gas relief valve disposed in the discharge manifold downstream of the inlet valve and, adapter means connected to the downstream end of the discharge manifold for connecting the apparatus to the conduit to be unclogged.

Accordingly, it is an object of this invention to provide means for effectively unclogging a blocked conduit.

Another object of the invention is to use a source of compressed has for unclogging a blocked conduit.

Another object of the invention is to use a source of compressed gas and a secondary source of compressed gas or liquid for unclogging a blocked conduit.

Another object of the invention is to use a source of compressed gas and a source of liquid for unclogging a blocked conduit.

These and other objects and advantages of the invention are believed made clear by the following description thereof taken in conjunction with the accompanying drawing wherein:

IN THE DRAWING

Figures 1, 2:
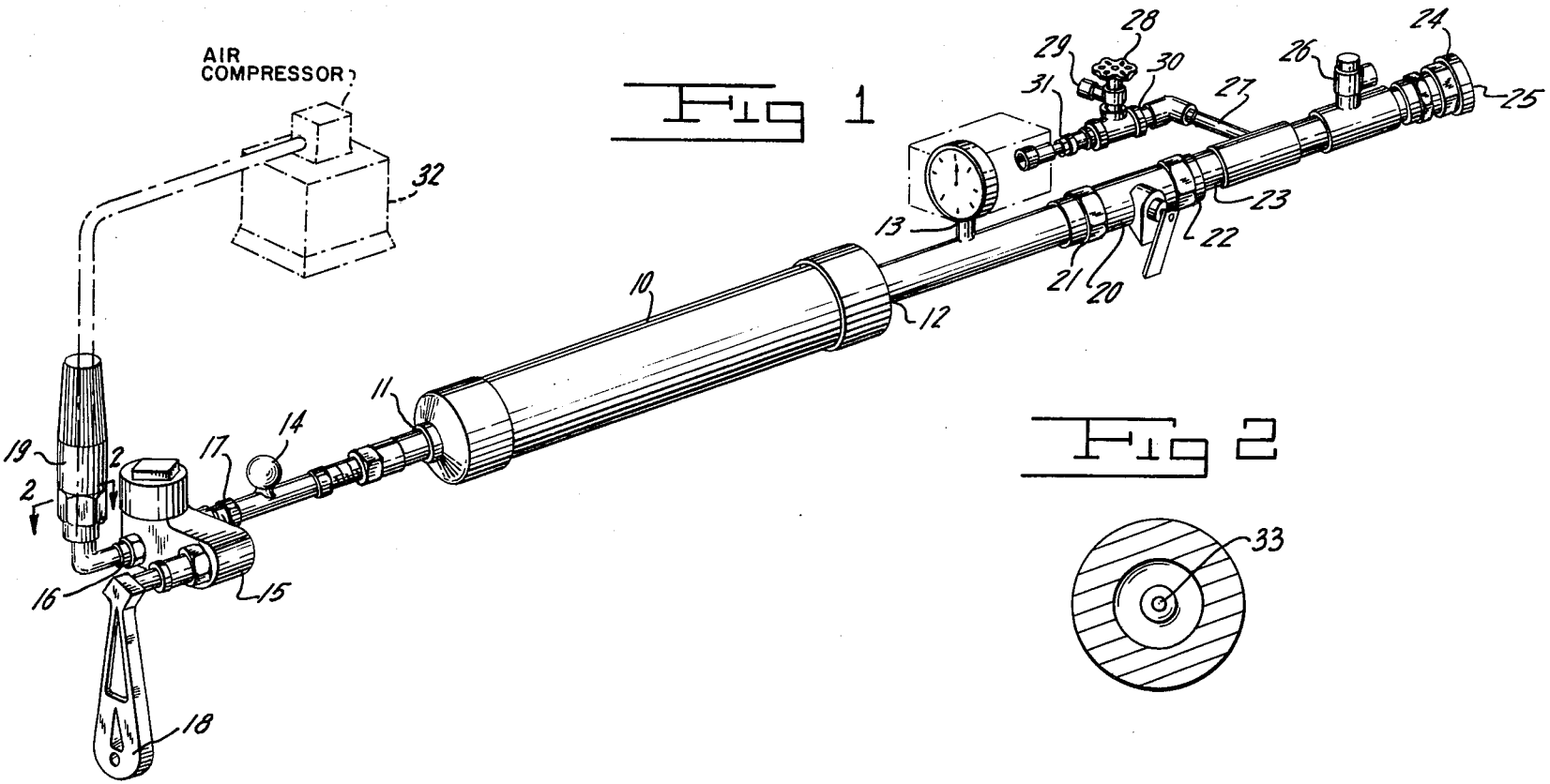
FIG. 1 is a perspective view of the device.
FIG. 2 is a sectional view of the device taken along line 2—2 of FIG. 1.

Referring now to the drawing, the apparatus comprises a central compressed gas receiving and storage chamber 10 having an inlet 11 and an outlet 12. A pressure gauge 13 is mounted in the chamber 10 for indicating the gas pressure in the chamber at any given time. A one-way check valve 14 is connected to the inlet 11 to prevent back-flow of gas from the chamber 10 when it is under pressure. Upstream of check valve 14 and flow connected to it is an inlet control valve 15 having an inlet 16 and an outlet 17 flow connected to the check valve 14, and an open - closed valve handle 18 for controlling the flow of compressed gas. The inlet 16 of control valve 15 is adapted to receive a removable carbon dioxide cartridge holder or 'blowgun' 19 which has disposed therein a firing pin or detonating pin 33 for releasing the contents of a carbon dioxide cartridge placed in the holder. Downstream of chamber 10 and connected to its outlet 12 is a discharge control valve 20 having an inlet 21 connected to chamber outlet 12 and an outlet 22 connected to the upstream end of a primary discharge manifold 23. The downstream end 24 of primary discharge manifold 23 is adapted to receive an adapter means 25 for connecting the apparatus to a conduit to be unclogged and, an automatic safety gas relief valve 26 is disposed in the manifold 23 downstream of discharge control valve 20. A secondary manifold 27 is flow connected to primary discharge manifold intermediate discharge control valve 20 and relief valve 26. A liquid flow control valve 28 having an inlet 29 and an outlet 30 is flow connected to secondary manifold 27 and a secondary gas control valve or petcock 31 is disposed upstream of liquid flow control valve 28 and is in fluid flow communication with secondary manifold 27. Thus, either liquid or secondary gas or both can be led into primary discharge manifold 23 through secondary manifold 27 depending upon whether or not valve 28 and 31 and opened or closed and for purposes to be discussed below.

It should be noted that carbon dioxide cartridge holder 19 can be removed from the inlet 16 of control valve 15 and a source of compressed gas, such as an air compressor, 32 can be connected to inlet 16 of valve 15 when desired and for pusposes to be more fully described below.

OPERATION

In operation, the apparatus is connected to the conduit to be unclogged by means of adapter 25, relief valve 26 is set for a desired pressure, valves 20, 28 and 31 are closed and air inlet control valve 15 is opened. Carbon dioxide cartridges are inserted into the removable carbon dioxide holder 19 one by one where the firing pin releases their pressure and allows the gas to flow into chamber 10 until a desired pressure, read out on gauge 13, is reached. Next, discharge control valve 20 is opened allowing the gas under pressure to escape from the chamber 10, through primary discharge manifold 23, and into the conduit to be unclogged. Discharge control valve 20 is then closed and liquid flow control valve 28 is opened allowing a flow of liquid into the primary discharge manifold 23 and into the now unclogged conduit to flush it clean. Should the conduit still be clogged the pressure relief valve 26 will open and the cycle can then be repeated.

Alternately, the following procedure may be used after the desired pressure is reached but before discharge control valve 20 is opened as explained above. Liquid flow control valve 28 is opened allowing a flow of liquid into the primary discharge manifold 23 and into the clogged conduit forming a head of liquid between the obstruction and the discharge control valve 20. Valve 20 is then opened allowing the gas under pressure to escape from the chamber 10, impacting the head of liquid and forcing the liquid and the gas through the conduit to be unclogged. Discharge control valve 20 is then closed, liquid flow control valve 28 is opened allowing a flow of liquid into the primary discharge manifold 23 and into the now unclogged conduit to flush it clean.

As a further alternative, carbon dioxide cartridge holder 19 is removed and a source of compressed gas, such as an air compressor, is connected to inlet of valve 15. The apparatus is connected to the conduit to be unclogged by means of adapter 25, relief valve 26 is set for a desired pressure, valves 28 and 31 are closed and valves 15 and 20 are opened. The source of compressed gas is allowed to flow through the apparatus and into the clogged conduit thus unclogging the conduit. Valve 20 is closed, valve 28 is opened, and liquid flows into the primary discharge manifold 23 and into the now unclogged conduit to flush it clean.

As another alternative, carbon dioxide cartridge holder 19 is removed and a source of compressed gas, such as an air compressor, is connected to inlet of valve 15. The apparatus is connected to the conduit to be unclogged by means of adapter 25, relief valve 26 is set for a desired pressure, valves 28 and 31 are closed and valves 15 and 20 are opened. The source of compressed gas is allowed to flow through the apparatus and into the clogged conduit and then valve 28 is opened allowing a flow of liquid into the primary discharge manifold 23 where it joins the high pressure gas stream before flowing to the conduit to be unclogged. Valve 20 is then closed and the liquid continues to flow to the now unclogged conduit to flush it clean.

If desired, the primary source of compressed air, such as the carbon dioxide cartridges or air compressor, can be eliminated by closing valve 20 and connecting valve 31 to a secondary source of compressed gas, such as an air holding tank shown in phantom. The apparatus is then connected to the conduit to be unclogged by means of adapter 25 and liquid flow control valve 28 is connected to a source of liquid not shown. Valve 28 is then opened to allow a flow of liquid into the primary discharge manifold 23 and into the conduit to be unclogged. Valve 31 is then opened to allow a flow of compressed gas from the secondary source into the discharge manifold and into the conduit to be unclogged. The combined flow of fluid and gas will unclog the conduit and then valve 31 is closed allowing the flow of fluid to flush out the conduit.

The apparatus described above can also be used for leak testing a conduit by connecting it to the conduit through adapter 25, closing valve 20, opening valves 28 and 31 which are connected to sources of liquid and compressed gas respectively, and injecting a colored dye into the liquid source. The combined flows will flow into the primary discharge manifold 23 and into the conduit to be tested. The combined flows, under pressure, will escape through any leak in the conduit and the colored dye will indicate where the leak is located.

The apparatus described above can also be used for leak testing a hidden or recessed conduit in the following manner: A second pressure gauge (not shown) is connected to the conduit to be tested, adapter 25 is connected to the other end of said conduit, valves 15 and 20 are closed, valves 28 and 31 are opened and the compressed gas from the holding tank mixes with the liquid and flows through the discharge manifolds and into the conduit to be tested. After a predetermined is shown on the second pressure gauge valves 28 and 31 are closed. If the pressure on the second gauge drops it will evidence a leak in the conduit. When the conduit is exposed, the dye from the liquid inlet will indicate the location of the leak.

Thus, what has been disclosed is a hydro-pneumatic pipe, tube and drain cleaner wherein a source of high pressure gas and/or liquid are used to effectively, safely and cleanly unclog stopped up conduits.

It will be understood that the invention is not to be limited to the specific construction or arrangement of the parts shown and that they may be modified widely within the invention defined by the claims.

What is claimed is:

1. Apparatus for cleaning clogged pipes, tubes, drains and other conduits, comprising:

a. a gas receiving and storage chamber having an inlet and an outlet and a pressure gauge disposed therein for indicating gas pressure in said chamber;

b. a check valve connected to said inlet of said chamber to prevent back-flow of gas from said chamber when pressurized;

c. an inlet control valve having an inlet and an outlet connected to said check valve for controlling the flow of pressurized gas to said chamber;

d. A removable carbon dioxide cartridge holder disposed in said inlet of said inlet control valve for receiving a series of carbon dioxide cartridges;

e. means disposed in said carbon dioxide cartridge holder for releasing the contents of said cartridges into said chamber;

f. a discharge control valve having an inlet and an outlet, said inlet connected to the outlet of said storage chamber for controlling the flow of pressurized gas therefrom;

g. a primary discharge manifold having an upstream end and a downstream end, said upstream end connected to said outlet of said discharge control valve for receiving a flow of pressurized gas therefrom when said valve is open, and said downstream end having an adapter for connecting the apparatus to a conduit to be unclogged;

h. an automatic safety gas relief valve disposed in said primary discharge manifold downstream of said discharge control valve;

i. a secondary manifold connected to said primary discharge manifold intermediate said discharge control valve and said relief valve;

j. a liquid flow control valve having an inlet and an outlet connected to said secondary manifold whereby a source of liquid can flow through said valve, into said secondary and primary manifold, and into the conduit to be unclogged; and, k. a secondary gas control valve disposed upstream of said liquid flow control valve in fluid flow communication with said secondary manifold whereby a source of secondary gas can flow through said valve, into said secondary and primary manifold, and into the conduit to be unclogged.

2. Apparatus for cleaning clogged pipes, tubes, drains and other conduits, comprising:

a. a gas receiving and storage chamber having an inlet and an outlet and a pressure gauge disposed therein for indicating gas pressure in said chamber;

b. a check valve connected to said inlet of said chamber to prevent back-flow of gas from said chamber when pressurized;

c. an inlet control valve having an inlet and an outlet connected to said check valve for controlling the flow of pressurized gas to said chamber;

d. a removable carbon dioxide cartridge holder disposed in said inlet of said inlet control valve for receiving a series of carbon dioxide cartridges;

e. means disposed in said carbon dioxide cartridge holder for releasing the contents of said cartridges into said chamber;

f. a discharge control valve having an inlet and an outlet, said inlet connected to the outlet of said storage chamber for controlling the flow of pressurized gas therefrom;

g. a primary discharge manifold having an upstream end and a downstream end, said upstream end connected to said outlet of said discharge control valve for receiving a flow of pressurized gas therefrom when said valve is open, and said downstream end having an adapter for connecting the apparatus to a conduit to be unclogged;

h. an air compressor connected to said inlet of said inlet control valve when said removable carbon dioxide cartridge holder is removed for furnishing a flow of compressed gas to said gas receiving and storage chamber;

i. an automatic safety gas relief valve disposed in said discharge manifold downstream of said discharge control valve;

j. a secondary manifold connected to said primary discharge manifold intermediate said discharge control valve and said relief valve;

k. a liquid flow control valve having an inlet and an outlet connected to said secondary manifold whereby a source of liquid can flow through said valve, into said secondary and primary manifolds, and into the conduit to be unclogged; and, l. a secondary gas control valve disposed upstream of said liquid flow control valve in fluid flow communication with said secondary manifold whereby a source of secondary gas can flow through said valve, into said secondary and primary manifold, and into the conduit to be unclogged.

* * * * *